US012663230B2

(12) United States Patent
Helmikkala et al.

(10) Patent No.: US 12,663,230 B2
(45) Date of Patent: Jun. 23, 2026

(54) FIREARM ATTACHABLE BULLET TRAP

(71) Applicant: Jägear Oy, Espoo (FI)

(72) Inventors: Ilkka Helmikkala, Espoo (FI); Saku Everi, Espoo (FI)

(73) Assignee: Jagear Oy, Espoo (FI)

( * ) Notice: Subject to any disclaimer, the term of this patent is extended or adjusted under 35 U.S.C. 154(b) by 71 days.

(21) Appl. No.: 18/890,204

(22) Filed: Sep. 19, 2024

(65) Prior Publication Data

US 2026/0085904 A1 Mar. 26, 2026

(30) Foreign Application Priority Data

Sep. 20, 2023 (FI) ..... 20236039

(51) Int. Cl.
*F41A 21/26* (2006.01)
*F41A 17/44* (2006.01)
*F41A 21/34* (2006.01)

(52) U.S. Cl.
CPC ..... *F41A 17/44* (2013.01); *F41A 21/34* (2013.01)

(58) Field of Classification Search
CPC ..... F41A 21/26; F42B 30/06
See application file for complete search history.

(56) References Cited

U.S. PATENT DOCUMENTS 1,671,327 A * 5/1928 Studler ..... F41A 21/26 89/14.5
3,620,162 A * 11/1971 King ..... F42B 30/06 42/105
3,766,822 A * 10/1973 Sophinos ..... F41A 21/26 89/14.5
6,026,728 A * 2/2000 Guhring ..... F41A 21/26 89/14.5
6,176,032 B1 * 1/2001 Cohen ..... F41A 17/44 42/96
6,889,593 B2 * 5/2005 Guhring ..... F41A 21/26 42/96

(Continued)

FOREIGN PATENT DOCUMENTS

GB 228558 A 4/1925

OTHER PUBLICATIONS

Search Report for FI20236039 dated Mar. 26, 2024, 1 page.
Finnish Office Action cited in U.S. Appl. No. 20/236,039 mailed Mar. 26, 2024, 5 pages.

*Primary Examiner* — Derrick R Morgan
(74) *Attorney, Agent, or Firm* — Nixon & Vanderhye P.C.

(57) ABSTRACT

A firearm attachable bullet trap (2) including a hollow body (3) configured to be releasable connected a muzzle end (7) of a rifle barrel (8) of a firearm (1). The hollow body (3) defining a ballistic plate chamber (9). The firearm attachable bullet trap (2) including a ballistic plate (12) in the ballistic plate chamber (9), and a bullet deforming part (14) within the hollow body (3), wherein the bullet deforming part (14) has a central channel (15), wherein the central channel (15) having a central axis A. The central channel (15) of the bullet deforming part (14) includes an open-sided channel section (17) that is radially limited by stationary cutter blades (18), wherein each stationary cutter blade (18) has a second proximal end (19) and a second distal (20). The stationary cutter blades (18) being equally spaced about the central axis A of the central channel (15).

17 Claims, 9 Drawing Sheets

(56) References Cited

U.S. PATENT DOCUMENTS

| | | | | |
|---|---|---|---|---|
| 8,156,855 | B2 * | 4/2012 | Anderson | F41A 21/32 89/14.05 |
| 8,499,676 | B1 * | 8/2013 | Moore | F41A 21/325 89/14.4 |
| 8,677,672 | B2 * | 3/2014 | Kennedy | F41A 21/32 42/96 |
| 12,467,708 | B2 * | 11/2025 | Groves | F41A 21/26 |
| 2010/0281747 | A1 * | 11/2010 | Anderson | F41A 21/26 42/90 |
| 2014/0173963 | A1 * | 6/2014 | Kent | F41A 21/32 42/90 |
| 2025/0060184 | A1 * | 2/2025 | Hoffman | F41A 33/00 |

* cited by examiner

FIREARM ATTACHABLE BULLET TRAP

RELATED APPLICATION

This application incorporates by reference and claims priority to Finnish patent application 20236039 filed Sep. 20, 2023.

FIELD OF THE INVENTION

The invention relates to firearm attachable bullet trap and particularly to a firearm attachable bullet trap that is configured to function as as a blank firing adaptor and adapted to effectively stop a live bullet if one is for example by mistake fired instead of a blank bullet.

SUMMARY OF DISCLOSURE

Firearm attachable bullet trap (2) is disclosed herein that includes a hollow body (3) configured to be releasable connected a muzzle end (7) of a rifle barrel (8) of a firearm (1), wherein the hollow body (3) defines a ballistic plate chamber (9) and wherein the hollow body (3) having a first proximal end (10) and a first distal end (11), and wherein the firearm attachable bullet trap (2) comprising a ballistic plate (12) in the ballistic plate chamber (9), a bullet deforming part (14) within the hollow body (3), wherein the bullet deforming part (14) has a central channel (15), wherein the central channel (15) having a central axis A, and a gas track (13) extending between the central channel (15) and the atmosphere, wherein the central channel (15) of the bullet deforming part (14) comprising an open-sided channel section (17) that is radially limited by stationary cutter blades (18), wherein each stationary cutter blade (18) has a second proximal end (19) and a second distal end (20), by the central channel (15) of the bullet deforming part (14) having a first proximal open end (21) at the second proximal end (19) of the stationary cutter blades (18) and a second distal end (22), and by the stationary cutter blades (18) being equally spaced about the central axis A of the central channel (15).

The firearm attachable bullet trap may include an open-end flash suppressor (4) that has elongated tines (5) projecting from a base (6) and that is attached to the muzzle end (7) of the rifle barrel (8) of the firearm (1), and by the hollow body (3) of the firearm attachable bullet trap (2) being releasably attached to the open-end flash suppressor (4).

Each stationary cutter blade (18) may have at least one of a stepped, a curved and an angled configuration so that the cross section of the closed-side channel section (16) of the central channel (15) reduces in steps and/or stepless towards the second distal end (22) of the central channel (15).

The bullet deforming part (14) may be releasably received within the hollow body (3).

The bullet deforming part (14) may be attached to the hollow body (3) with a connection means that is configured to break and/or deform and to allow the bullet deforming part (14) to move with respect to the hollow body (3) in response to receiving kinetic energy from a live bullet (23) moving in the central channel (15).

The bullet deforming part (14) may be secured against rotation in the hollow body (3).

The central channel (15) may include a closed-sided channel section (16) extending from the open-sided channel section (17).

The closed-sided channel section (16) of the central channel (15) being a blind hole extending from the open-sided channel section (17), wherein the second distal end (22) of the central channel (15) being the bottom of said blind hole.

The closed-sided channel section (16) of the central channel (15) may be a through hole extending from the open-sided channel section (17), wherein the second distal end (22) of the central channel (15) opening up into the ballistic plate chamber.

The bullet deforming part (14) may include a body part (25), by the closed-side channel section (16) being formed in the body part (25), and by the stationary cutter blades (18) projecting from the body part (25).

The bullet deforming part (14) may include at a third distal end (34) a recess (33) that is located at an extension of the central axis A of the central channel (15) of the bullet deforming part (14), and by the ballistic plate chamber (9) being formed between the recess (33) and the ballistic plate (12).

The bullet deforming part (14) may be configured to plastically deform in response to receiving kinetic energy from a live bullet (23) moving in the central channel (15).

Each stationary cutter blade (18) may have the same or similar configuration.

The open-sided channel section (17) of the central channel (15) of the bullet deforming part (14) may have a longitudinal slit (26) between two adjacent stationary cutter blades (18).

Each longitudinal slit (26) between two adjacent stationary cutter blades (18) opening up into a longitudinal space (27) may be formed between two adjacent stationary cutter blades (18).

The elongated tines (5) of the open-end flash suppressor (4) may be, when the bullet trap is releasable connected to the open-end flash suppressor (4), configured to project into the longitudinal spaces (17), which are formed between two adjacent stationary cutter blades (18), and by the elongated tines (5) of the open-end flash suppressor (4) being configured to abut the stationary cutter blades (18).

Each stationary cutter blade (18) may have an anticlockwise side in a circumferential direction about the central axis A of the central channel (15), by each stationary cutter blade (18) has a clockwise side in a circumferential direction about the central axis A of the central channel (15), by the elongated tines (5) of the open-end flash suppressor (4) being configured to abut one of the clockwise side of the stationary cutter blades (18) and the anticlockwise side of the stationary cutter blades (18), and by an elongated space (35) being formed between the elongated tines (5) of the open-end flash suppressor (4) and the other of the anticlockwise side of the stationary cutter blades (18) and the clockwise side of the stationary cutter blades (18).

SUMMARY OF FIGURES

In the following the invention will be described in more detail by referring to the figures of which

DETAILED DESCRIPTION

Figure 1:
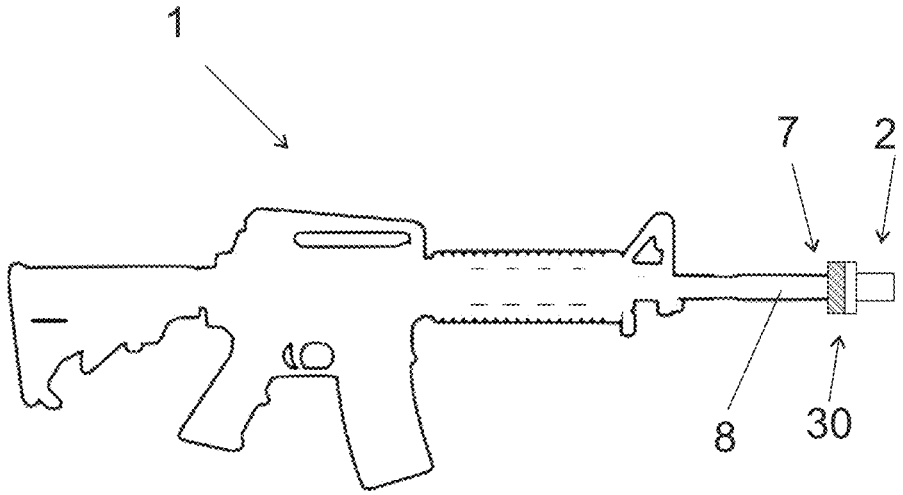
FIG. 1 shows a firearm to which muzzle end a bullet trap according to one embodiment is releasable attached.
Figure 2:
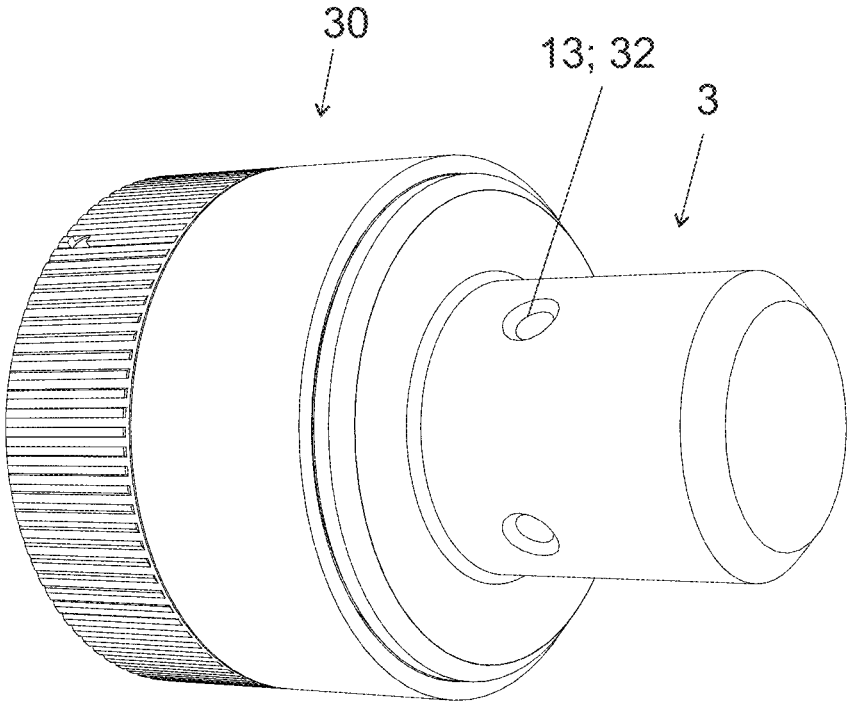
FIG. 2 shows a firearm attachable bullet trap according to one embodiment and that is releasable attached to a connecting device configured to be releasable attached to an open-end flash suppressor.
Figure 3:
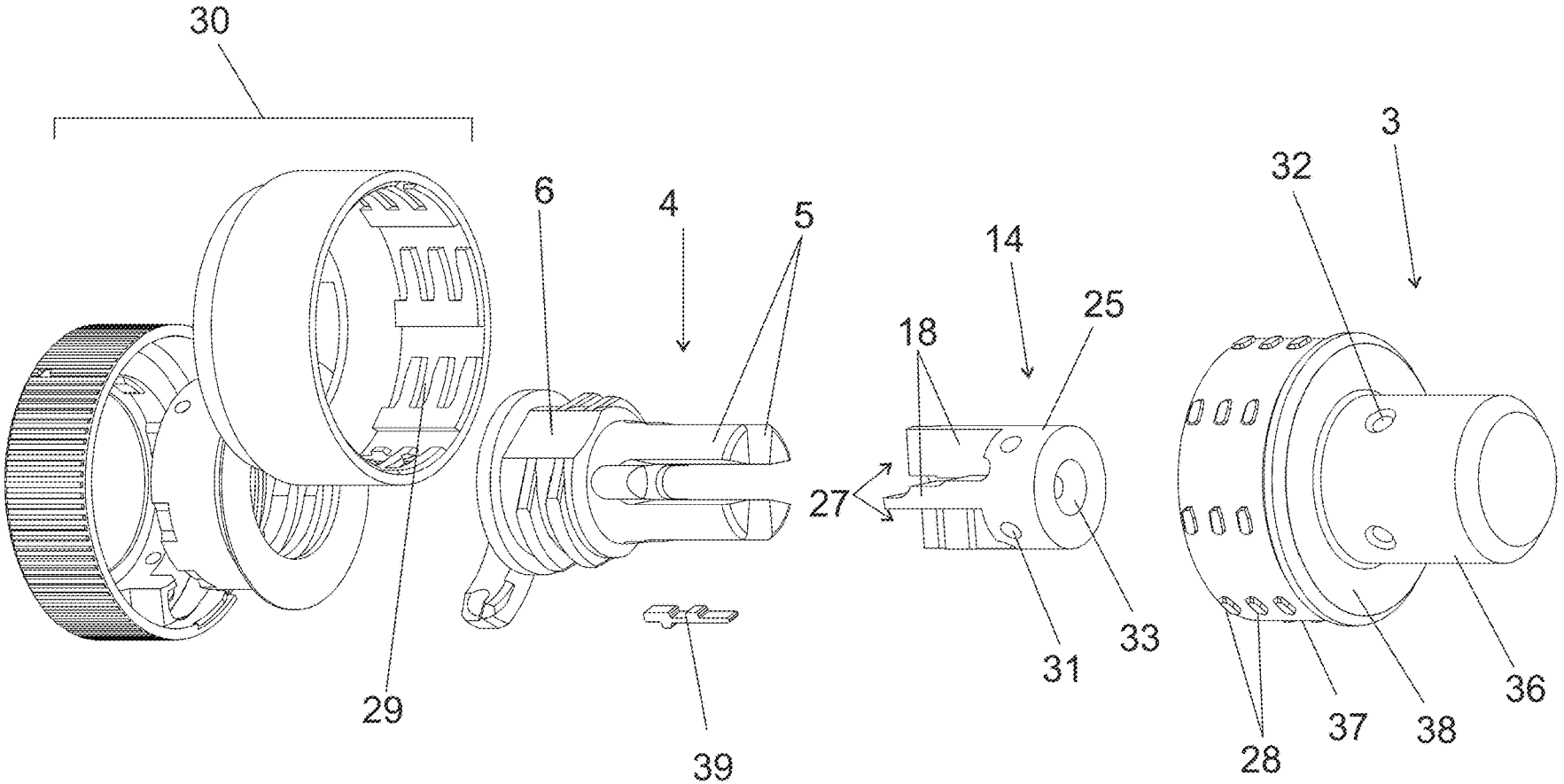
FIG. 3 shows the firearm attachable bullet trap illustrated in FIG. 2 in disassembled state and shows additionally in disassembled state parts of the connecting device illustrated in FIG. 2 and an open-end flash suppressor.
Figure 4:
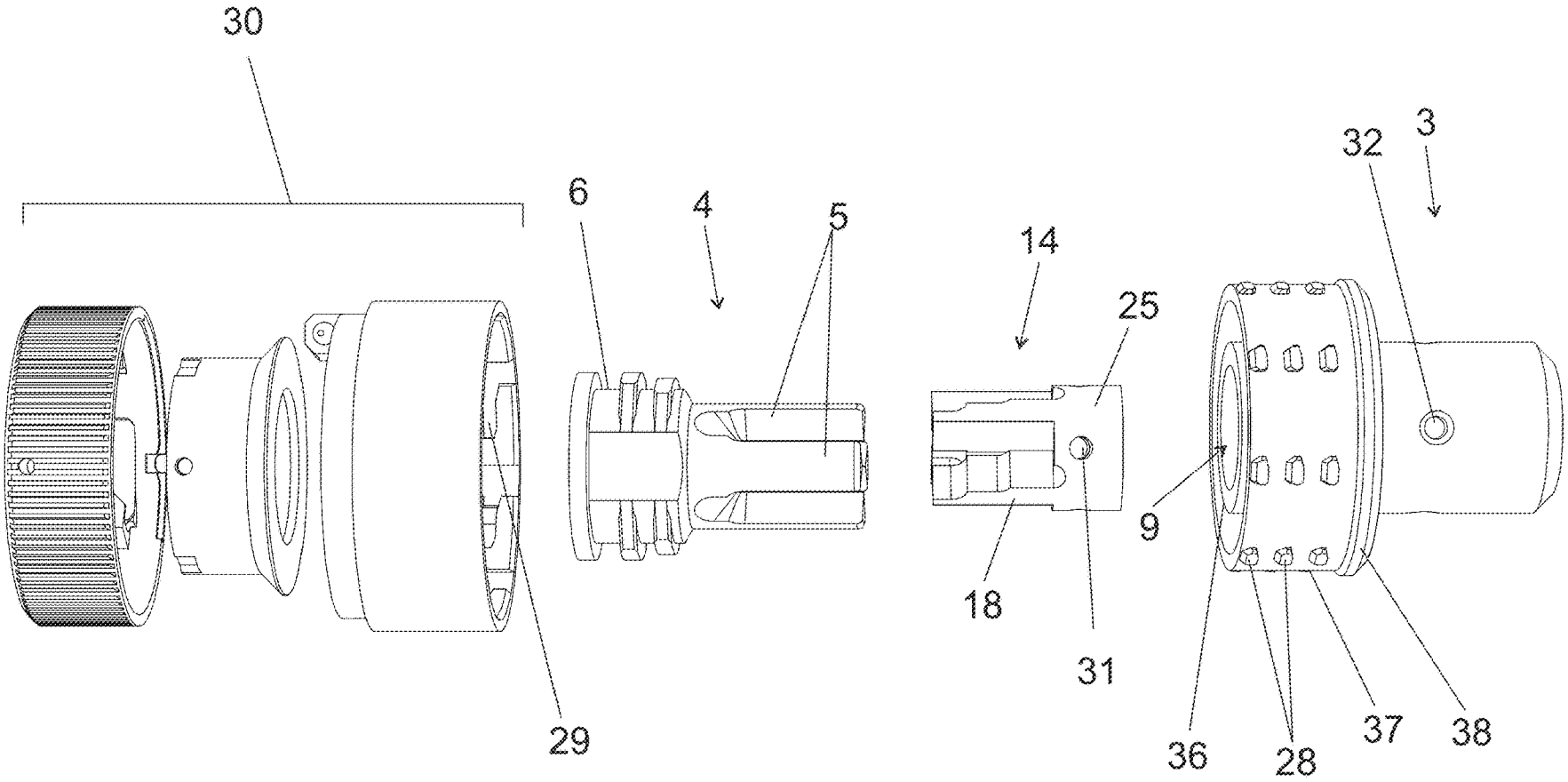
FIG. 4 shows the firearm attachable bullet trap illustrated in FIG. 2 in disassembled state and shows additionally in disassembled state parts of the connecting device illustrated in FIG. 2 and an open-end flash suppressor.
Figure 5:
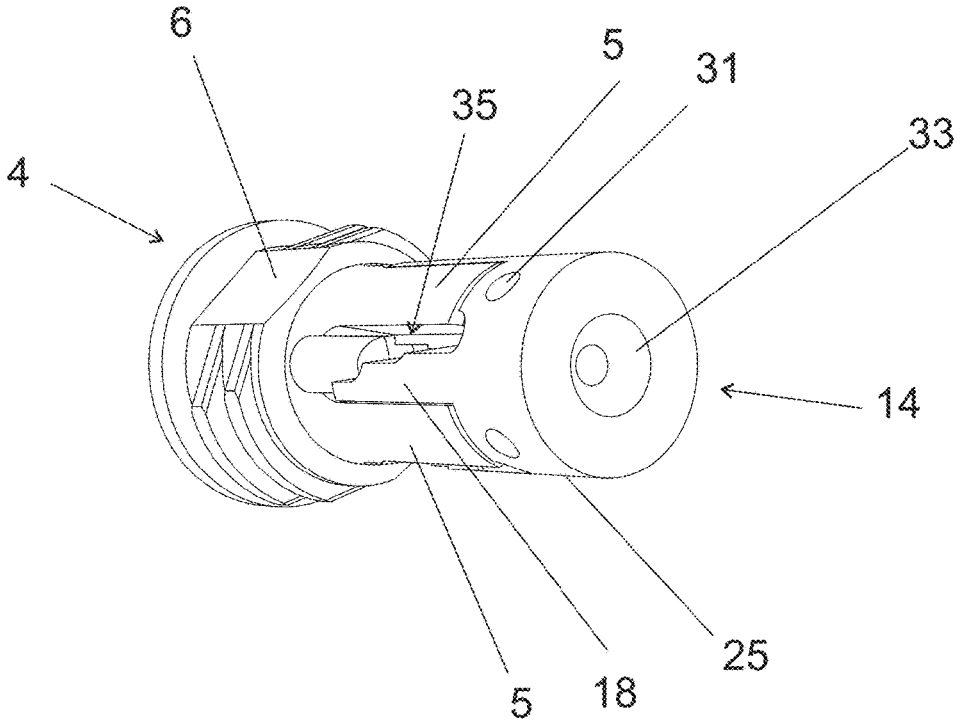
FIG. 5 shows the bullet deforming part of the firearm attachable bullet trap illustrated in FIG. 2 in as state where the firearm attachable bullet trap is connected to an open-end flash suppressor.
Figure 6:
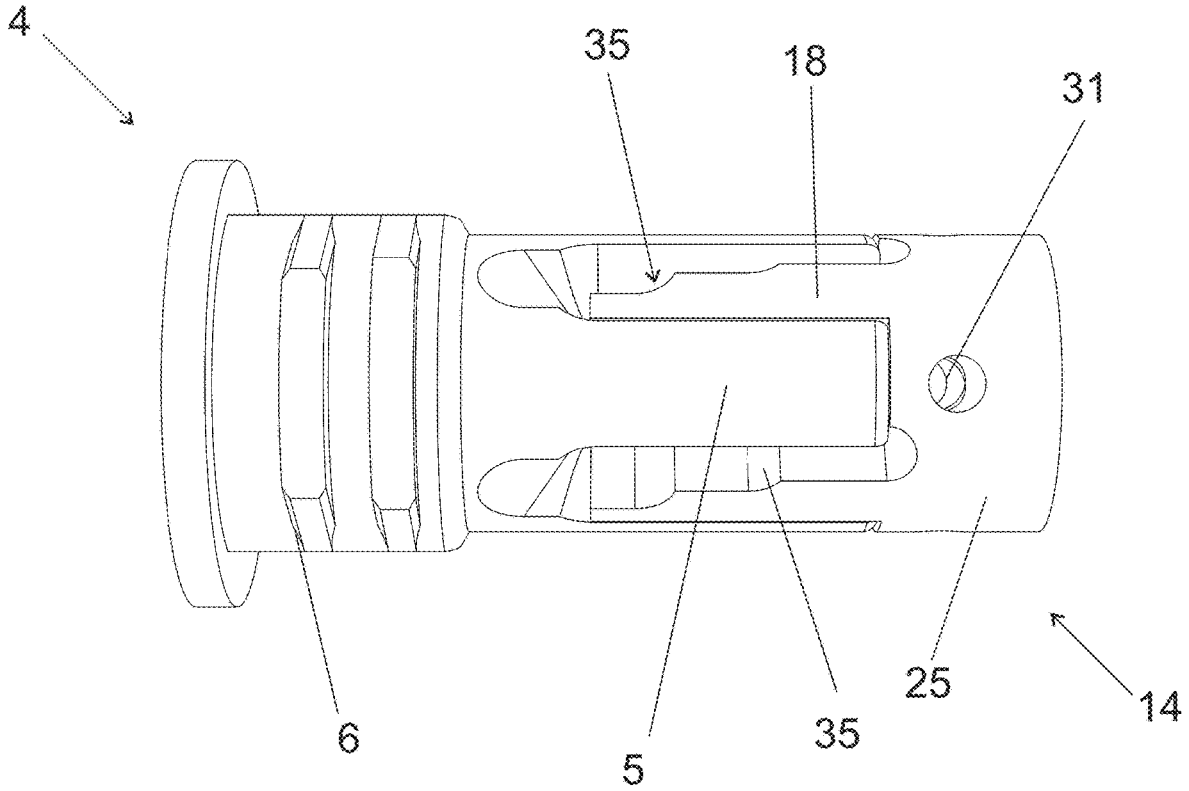
FIG. 6 shows the bullet deforming part of the firearm attachable bullet trap illustrated in FIG. 2 in as state where the firearm attachable bullet trap is connected to an open-end flash suppressor.
Figure 7:
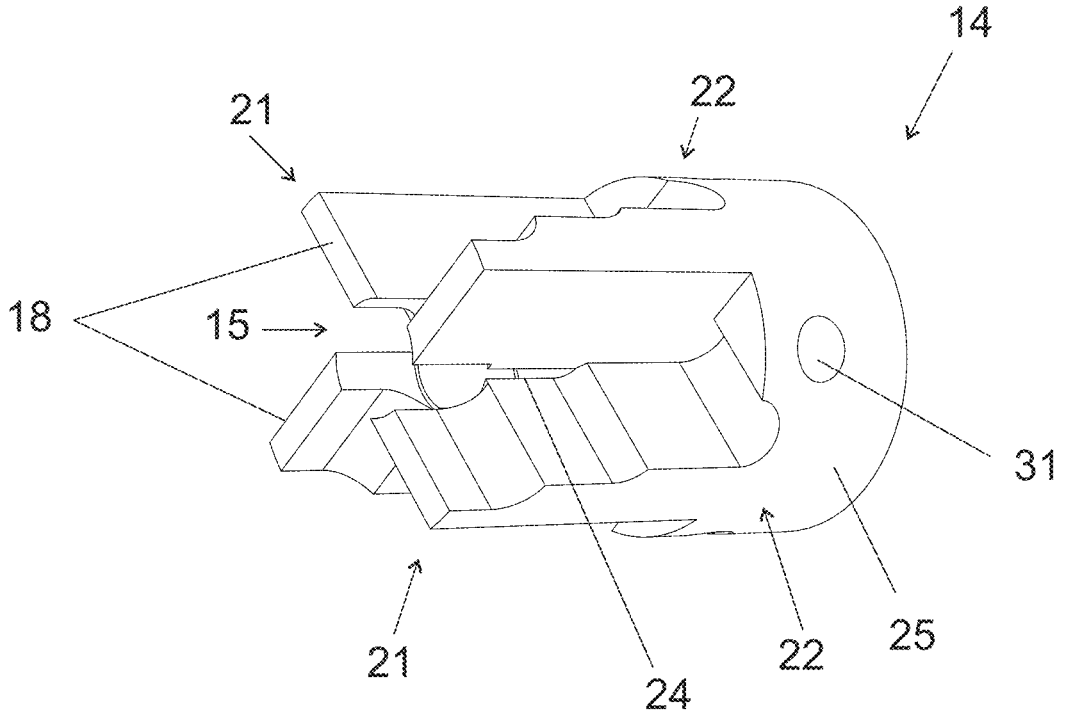
FIG. 7 shows the bullet deforming part of the firearm attachable bullet trap illustrated in FIG. 2.
Figure 8:
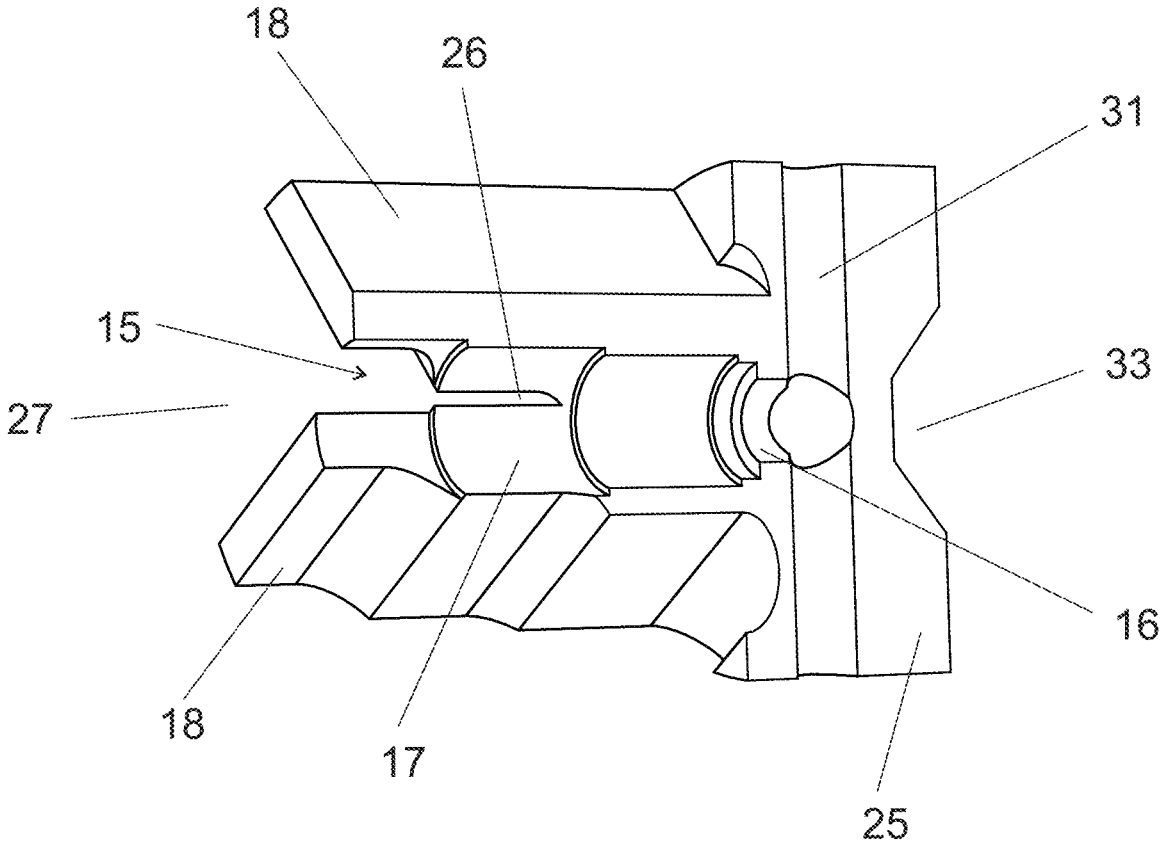
FIG. 8 shows the bullet deforming part of the firearm attachable bullet trap illustrated in FIG. 2 in partly cut state.
Figure 9:
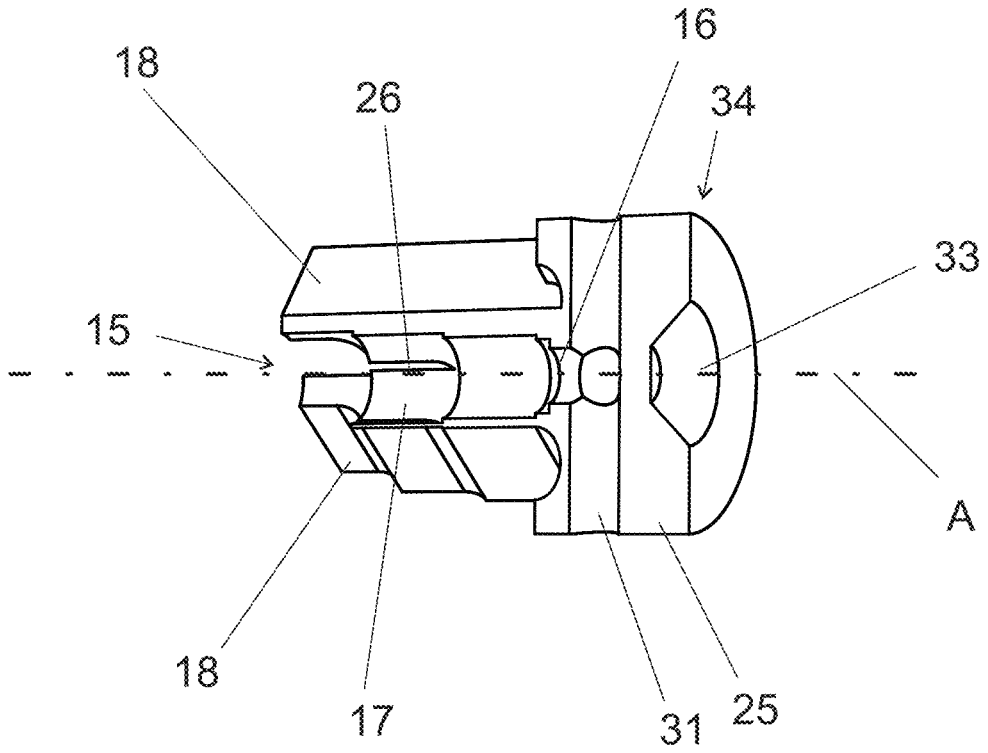
FIG. 9 shows the bullet deforming part of the firearm attachable bullet trap illustrated in FIG. 2 in partly cut state.
Figure 10:
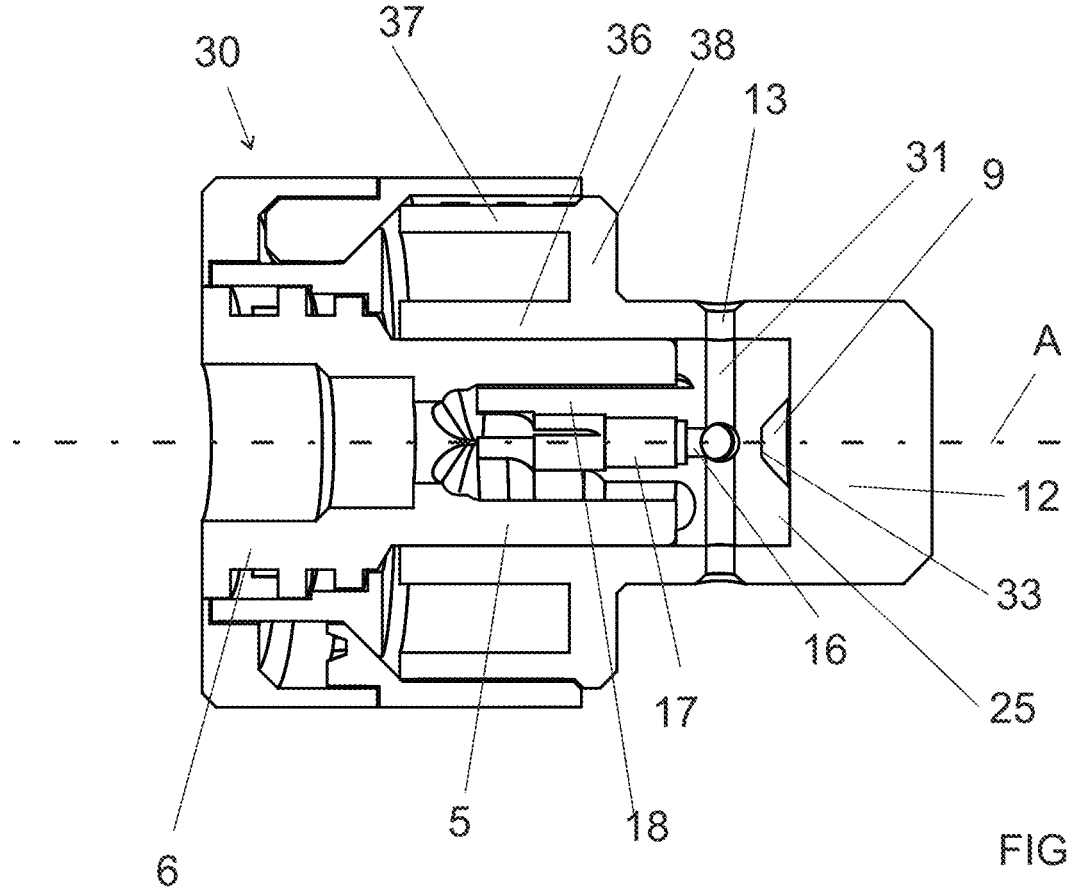
FIG. 10 shows in section view a firearm attachable bullet trap according to one embodiment and that is releasable attached to a connecting device releasable attached to an open-end flash suppressor.
Figure 11:
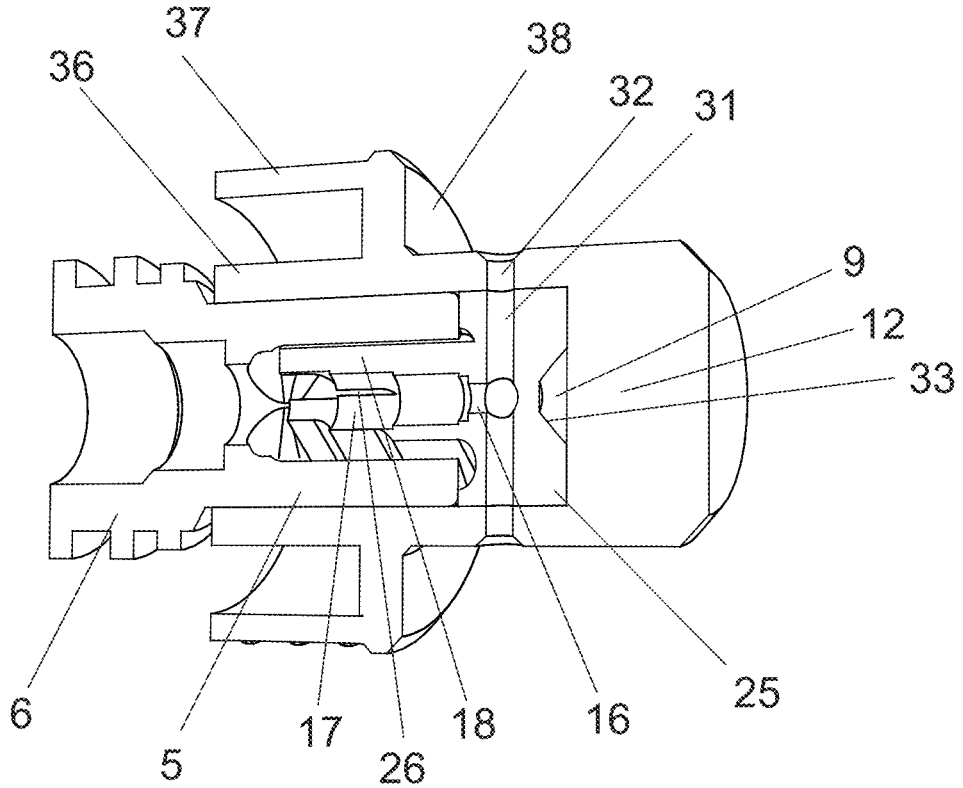
FIG. 11 shows in section view a firearm attachable bullet trap according to one embodiment and releasable connected to an open-end flash suppressor.
Figure 12:
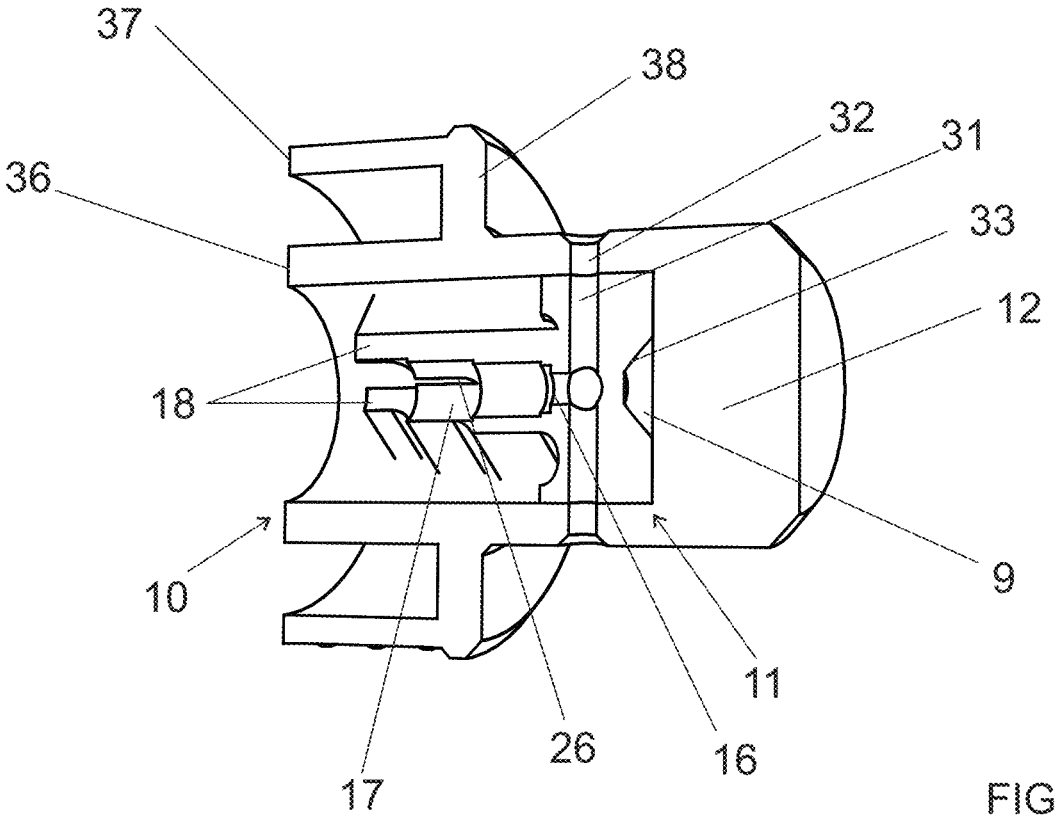
FIG. 12 shows in section view a firearm attachable bullet trap according to one embodiment.

The figures show embodiments and parts of embodiments of the firearm attachable bullet trap 2.

The firearm attachable bullet trap 2 comprising a hollow body 3 configured to be releasable connected to a muzzle end 7 of a rifled barrel 8 of a firearm 1.

The hollow body 3 at least partially defining a ballistic plate chamber 9.

The hollow body 3 having a first proximal end 10 and a first distal end 11.

The firearm attachable bullet trap 2 comprises a ballistic plate 12 in the ballistic plate chamber 9.

The firearm attachable bullet trap 2 comprises a bullet deforming part 14 releasable received within the hollow body 3.

The bullet deforming part 14 has a central channel 15, wherein the central channel 15 having a central axis A.

The firearm attachable bullet trap 2 comprises a gas track 13 extending between the central channel 15 and the atmosphere (not marked with a reference number).

The central channel 15 of the bullet deforming part 14 is preferably, but not necessarily, fully aligned with the rifle barrel 8 of the firearm 1 when the hollow body 3 is releasable connected to the muzzle end 7 of the rifled barrel 8 of the firearm 1 and when the bullet deforming part 14 releasable received within the hollow body 3.

The central channel 15 of the bullet deforming part 14 comprising an open-sided channel section 17 that is radially limited by stationary cutter blades 18. Each stationary cutter blade 18 has a second proximal end 19 and a second distal end 20.

The central channel 15 of the bullet deforming part 14 having a first proximal open end 21 at the second proximal end 19 of the stationary cutter blades 18 and a second distal end 22.

The stationary cutter blades 18 are equally spaced about the central axis A of the central channel 15.

Because of the stationary cutter blades 18, the firearm attachable bullet trap 2 can effectively slow down and stop the rotation of a live bullet 23 fired from the muzzle end 7 of the rifled barrel 8 of a firearm 1. The stationary cutter blades 18 will additionally cause material (not illustrated in the figures) to be detached from the outer surface of the live bullet 23 and this will decrease the mass of the live bullet 23 which in turn decreases the kinetic energy of the live bullet 23 before the live bullet 23 directly or indirectly is stopped by the ballistic plate 12 at the first distal end 11 of the ballistic plate chamber 9.

A muzzle device, such as an open end flash suppressor 4 that has elongated tines 5 projecting from a base 6, is preferably, but not necessarily, attached to the muzzle end 7 of the rifle barrel 8 of the firearm 1, and the hollow body 3 of the firearm attachable bullet trap 2 is configured to be releasable connected to the muzzle end 7 of the rifle barrel 8 of the firearm 1 by being releasably attached or attachable to the muzzle device such as to the open-end flash suppressor 4.

Each stationary cutter blade 18 has preferably, but not necessarily, at least one of a stepped, a curved and an angled configuration so that the cross section, such as the diameter, of the closed-side channel section 16 of the central channel 15 reduces in steps and/or stepless towards the second distal end 22 of the central channel 15.

The bullet deforming part 14 is preferably, but not necessarily, releasable received within the hollow body 3. The can alternatively be fixedly fastened within the hollow body 3 or be integrally formed with the hollow body so that the hollow body and the bullet deforming part 14 together forms a monolithic structure.

If the bullet deforming part 14 is releasable received within the hollow body 3, the bullet deforming part 14 is preferably, but not necessarily, attached to the hollow body 3 with a connection means that is configured to break and/or to deform and to allow the bullet deforming part 14 to move with respect to the hollow body 3 in response to receiving kinetic energy from a live bullet 23 moving in the central channel 15 and thus consumes kinetic energy of the live bullet 23. The optional connection means comprise preferably, but not necessarily, a locking ring, such as a retaining ring or a snap ring, that surrounds the bullet deforming part 14 and that is surrounded by the hollow body 3. At least one of the bullet deforming part 14 and the hollow body 3 can comprise annular grooves configured to receive the locking ring. It is also possible that the optional connection means additionally comprise or alternatively are formed by a press- or friction connection between the bullet deforming part 14 and the hollow body 3 which press- or friction connection keeps the bullet deforming part 14 releasably received in the hollow body 3, but that allows allow the bullet deforming part 14 to move with respect to the hollow body 3 in response to receiving kinetic energy from a live bullet 23 moving in the central channel 15 and thus consumes kinetic energy of the live bullet 23.

The bullet deforming part 14 is preferably, but not necessarily, secured against rotation in the hollow body 3.

The central channel 15 comprises preferably, but not necessarily, as in the embodiments illustrated in the figures additionally a closed-sided channel section 16 extending from the open-sided channel section 17. The closed-sided channel section 16 of the central channel 15 can, as in the embodiments illustrated in the figures, be a blind hole extending from the open-sided channel section 17, wherein the second distal end 22 of the central channel 15 being the bottom of said blind hole. The closed-sided channel section 16 of the central channel 15 can alternatively be a through hole extending from the open-sided channel section 17, wherein the second distal end 22 of the central channel 15 opening up into the ballistic plate chamber 9. If the central channel 15 comprises a closed-sided channel section 16 extending from the open-sided channel section 17, the gas track 13 can comprise a first gas track section 32 extending through the hollow body 3 and a second gas track section 31 extending from the closed-sided channel section 16 of the central channel 15 and opening up at the outer surface of the bullet deforming part 14. The second gas track section 31 and the first gas track section 32 are preferably, but not necessarily, aligned so that the second gas track section 31 opening up at the outer surface of the bullet deforming part 14 into the first gas track section 32. The bullet deforming part 14 comprising preferably, but not necessarily, a body part 25, wherein the closed-side channel section 16 being formed in the body part 25, and the stationary cutter blades 18 projecting from the body part 25.

bullet deforming part 14 comprises preferably, but not necessarily, at a third distal end 34 of the bullet deforming part 14 a recess 33 that is located at an extension of the central axis A of the central channel 15 of the bullet deforming part 14, wherein the ballistic plate chamber 9 being formed between the recess 33 and the ballistic plate 12.

The bullet deforming part 14 is preferably, but not necessarily, configured to plastically deform in response to receiving kinetic energy from a live bullet 23 moving in the central channel 15. Such plastically deforming absorbs energy from the live bullet 23.

Each stationary cutter blade 18 has preferably, but not necessarily, a cutting edge 24, and the cutting edges 24 are preferably, but not necessarily, equally spaced about the central axis A. Each cutting edge 24 has preferably, but not necessarily, the same configuration.

Each stationary cutter blade 18 has preferably, but not necessarily, the same configuration.

Each stationary cutter blade 18 has preferably, but not necessarily, an anticlockwise side (not marked with a reference numeral) in a circumferential direction about the central axis A of the central channel 15, and each stationary cutter blade 18 has preferably, but not necessarily, a clockwise side (not marked with a reference numeral) in a circumferential direction about the central axis A of the central channel 15. If each stationary cutter blade 18 has an anticlockwise side in a circumferential direction about the central axis A of the central channel 15, and if each stationary cutter blade 18 has a clockwise side in a circumferential direction about the central axis A of the central channel 15, the anticlockwise side of each stationary cutter blade 18 has preferably, but not necessarily, the same configuration. If each stationary cutter blade 18 has an anticlockwise side in a circumferential direction about the central axis A of the central channel 15, and if each stationary cutter blade 18 has a clockwise side in a circumferential direction about the central axis A of the central channel 15, the clockwise side of each stationary cutter blade 18 has preferably, but not necessarily, the same configuration.

The open-sided channel section 17 of the central channel 15 of the bullet deforming part 14 has preferably, but not necessarily, longitudinal slits 26 extending in the direction of the central axis A so that the stationary cutter blades 18 being formed between the longitudinal slits 26. Such longitudinal slits 26 provides for a path for material that is removed from a live bullet 23 to escape from the open-sided channel section 17 of the central channel 15.

The open-sided channel section 17 of the central channel 15 of the bullet deforming part 14 has preferably, but not necessarily, a longitudinal slit 26 between two adjacent stationary cutter blades 18. If the open-sided channel section 17 of the central channel 15 of the bullet deforming part 14 has a longitudinal slit 26 between two adjacent stationary cutter blades 18, each longitudinal slit 26 between two adjacent stationary cutter blades 18 opens preferably, but not necessarily, up into a longitudinal space 27 that is formed between two adjacent stationary cutter blades 18. If an open end flash suppressor 4 that has elongated tines 5 projecting from a base 6, is attached to the muzzle end 7 of the rifle barrel 8 of the firearm 1, and if the hollow body 3 of the firearm attachable bullet trap 2 is configured to be releasable connected to the muzzle end 7 of the rifle barrel 8 of the firearm 1 by being releasably attached or attachable to the muzzle device such as to the open-end flash suppressor 4, the elongated tines 5 of the open end flash suppressor 4 being, when the firearm attachable bullet trap 2 is releasable connected to the open end flash suppressor 4 and when the bullet deforming part 14 releasable received within the hollow body 3, preferably, but not necessarily, configured to project into the longitudinal spaces 27, which are formed between two adjacent stationary cutter blades 18, so the elongated tines 5 of the open end flash suppressor 4 being configured to abut the stationary cutter blades 18. In such case, each stationary cutter blade 18 has preferably, but not necessarily, an anticlockwise side in a circumferential direction about the central axis A of the central channel 15 and each stationary cutter blade 18 has preferably, but not necessarily, a clockwise side in a circumferential direction about the central axis A of the central channel 15, wherein the elongated tines 5 of the open-end flash suppressor 4 being configured to abut one of the clockwise side of the stationary cutter blades 18 and the anticlockwise side of the stationary cutter blades 18 so that an elongated space 35 is formed between the elongated tines 5 of the open-end flash suppressor 4 and the other of the anticlockwise side of the stationary cutter blades 18 and the clockwise side of the stationary cutter blades 18. Each longitudinal space 27 can be sized and shaped for complementary receipt of at least a portion of one tine/prong of the open-end flash suppressor 4.

For releasable attaching of the hollow body 3 of the firearm attachable bullet trap 2 to a muzzle end 7 of a rifled barrel 8 of a firearm 1, preferably as to a muzzle device that is attached to a muzzle end 7 of a rifled barrel 8 of a firearm 1, more preferably to an open end flash suppressor 4 that has elongated tines 5 projecting from a base 6 and that is attached to a muzzle end 7 of a rifled barrel 8 of a firearm 1, the hollow body 3 can comprise a first threading (not illustrated in the figures) on one of an outer surface or an inner surface at the first proximal end 10 of the hollow body 3. The first threading can be configured to co-operate with a second threading (not illustrated in the figures) provided on the other of outer surface and an inner surface of a connecting device 30 that is configured to be releasable attached to the muzzle end 7 of rifled barrel 8 of a firearm 1, preferably to the muzzle device that is attached to the muzzle end 7 of rifled barrel 8 of the firearm 1, more preferably to the open-end flash suppressor 4.

For releasable attaching of the hollow body 3 of the firearm attachable bullet trap 2 to a muzzle end 7 of a rifled barrel 8 of a firearm 1, preferably as to a muzzle device that is attached to a muzzle end 7 of a rifled barrel 8 of a firearm 1, more preferably to an open end flash suppressor 4 that has elongated tines 5 projecting from a base 6 and that is attached to a muzzle end 7 of rifled barrel 8 of a firearm 1, the hollow body 3 can comprise one of pins 28 and bayonet grooves 29 provided on one of an outer surface and an inner surface of the hollow body 3 at the first proximal end 10 of the hollow body 3. The pins 28 or bayonet grooves 29 on one of an outer surface and an inner surface at the first proximal end 10 of the hollow body 3 can be configured to co-operate with the other of pins 28 and bayonet grooves 29 provided at the other of an inner surface and an outer surface of a connecting device 30 that is configured to the muzzle end 7 of rifled barrel 8 of a firearm 1, preferably to the muzzle device that is attached to the muzzle end 7 of rifled barrel 8 of the firearm 1, more preferably to be releasable attached to the open end flash suppressor 4. A locking device 39 can be provided to lock the hollow body 3 of the firearm attachable bullet trap 2 to the connecting device 30 when the pins 28 are received in the bayonet grooves 29.

The hollow body 3 is preferably, but not necessarily, made of metal.

The bullet deforming part 14 is preferably, but not necessarily, made of metal.

The hollow body 3 surrounds and radially abuts preferably, but not necessarily, the elongated tines 5 of the open-end flash suppressor 4 when the hollow body 3 is releasable connected to the to the open-end flash suppressor 4 that is attached to the muzzle end 7 of the rifle barrel 8 of the firearm 1. This provides for additional support for the elongated tines 5 of the open-end flash suppressor 4 in case a live bullet 23 is fired and the elongated tines 5 of the open-end flash suppressor 4 are subjected to kinetic energy originating from the live bullet 23. The hollow body 3 surrounds and radially abuts preferably, but not necessarily, the stationary cutter blades 18 of the bullet deforming part 14 when the bullet deforming part 14 is releasable received in the hollow body 3. This provides for additional support for the stationary cutter blades 18 of the bullet deforming part 14 in case a live bullet 23 is fired and the stationary cutter blades 18 of the bullet deforming part 14 are subjected to kinetic energy originating from the live bullet 23.

The hollow body 3 comprises preferably, but not necessarily, as in the embodiments illustrated in the figures, an inner tubular part 36 and an outer tubular part 37 that concentrically surrounds the inner tubular part 37, wherein the inner tubular part 36 and the outer tubular part 37 being joined by a flange part 38. The inner tubular part 36 of the hollow body 3 surrounds and radially abuts preferably, but not necessarily, as in the embodiments illustrated in the figures, the elongated tines 5 of the open-end flash suppressor 4 when the hollow body 3 is releasable connected to the to the open-end flash suppressor 4 that is attached to the muzzle end 7 of the rifle barrel 8 of the firearm 1. This provides for additional support for the elongated tines 5 of the open-end flash suppressor 4 in case a live bullet 23 is fired and the elongated tines 5 of the open-end flash suppressor 4 are subjected to kinetic energy originating from the live bullet 23. The inner tubular part 36 of the hollow body 3 surrounds and radially abuts preferably, but not necessarily, as in the embodiments illustrated in the figures, the stationary cutter blades 18 of the bullet deforming part 14 when the bullet deforming part 14 is releasable received in the hollow body 3. This provides for additional support for the stationary cutter blades 18 of the bullet deforming part 14 in case a live bullet 23 is fired and the stationary cutter blades 18 of the bullet deforming part 14 are subjected to kinetic energy originating from the live bullet 23.

FIGS. 13 to 16 shows in section view a firearm attachable bullet trap according to one embodiment and that is releasable attached to a connecting device releasable attached to an open-end flash suppressor and illustrates the function of the firearm attachable bullet trap.

Figure 13:
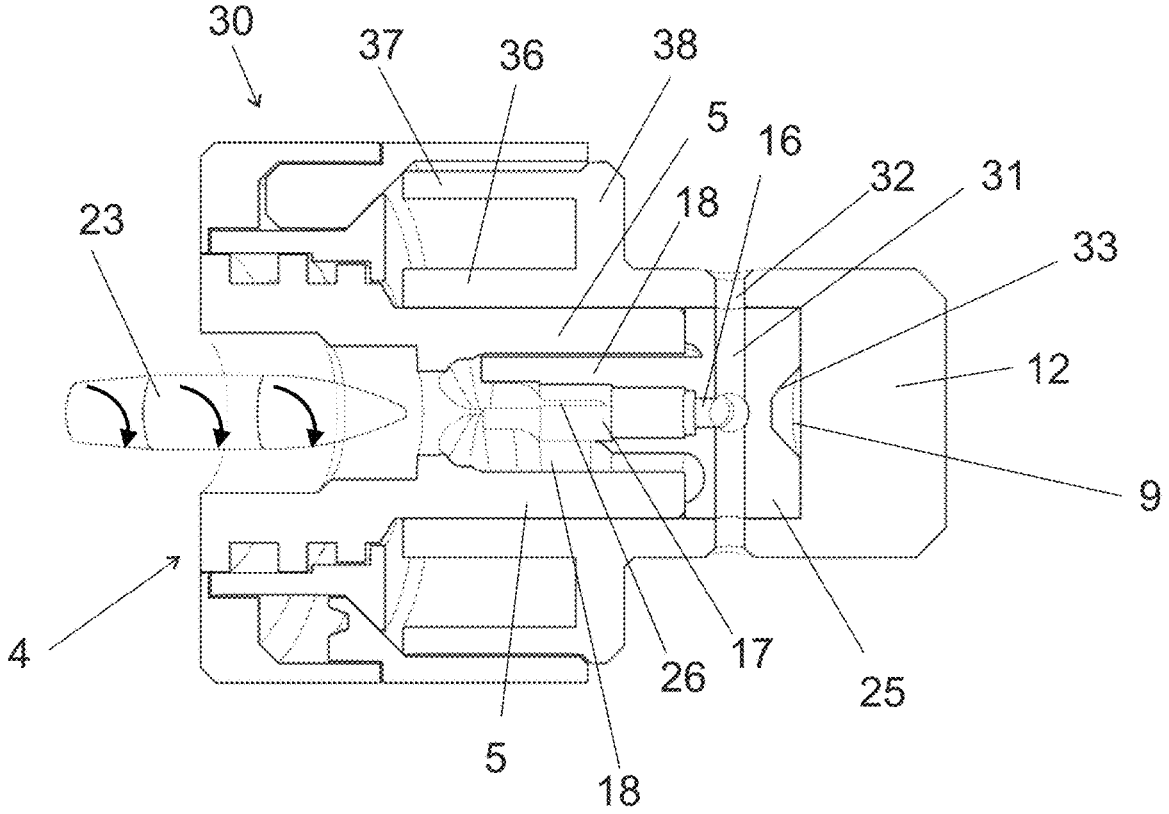
FIGS. 13 to 16 shows in section view a firearm attachable bullet trap according to one embodiment and that is releasable attached to a connecting device releasable attached to an open-end flash suppressor and illustrates the function of the firearm attachable bullet trap.

In FIG. 13, a live bullet 23 has entered the open-end flash suppressor 4 from the muzzle end 7 of a rifle barrel 8 of a firearm 1 and the live bullet 23 rotates as the live bullet 23 advances through the open-end flash suppressor 4, because the open-end flash suppressor 4 is attached to the muzzle end 7 of a rifle barrel 8 of a firearm 1 and the rifle barrel 8 causes rotation of the live bullet 23.

Figure 14:
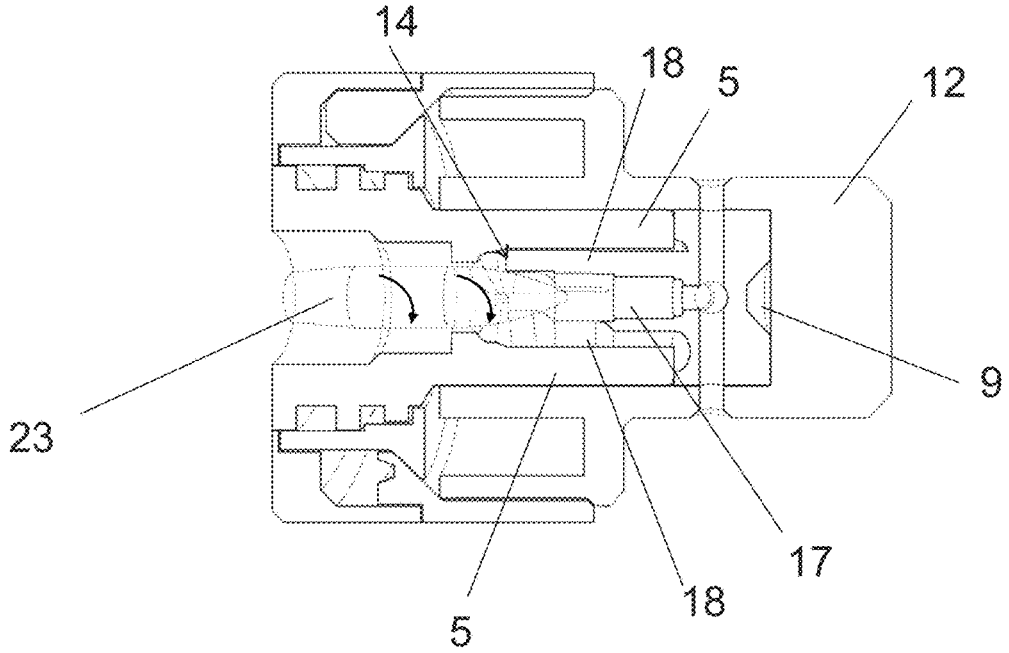

In FIG. 14, the live bullet 23 enters the first proximal end 21 of the bullet deforming part 14 and the stationary cutter blades 18 of the bullet deforming part 14 is hit by the outer surface (not marked with a reference numeral) of the live bullet 23 causing the rotation of the live bullet 23 to slow down and causing material (not illustrated in the figures) to be detached from the outer surface of the live bullet 23.

Figure 15:
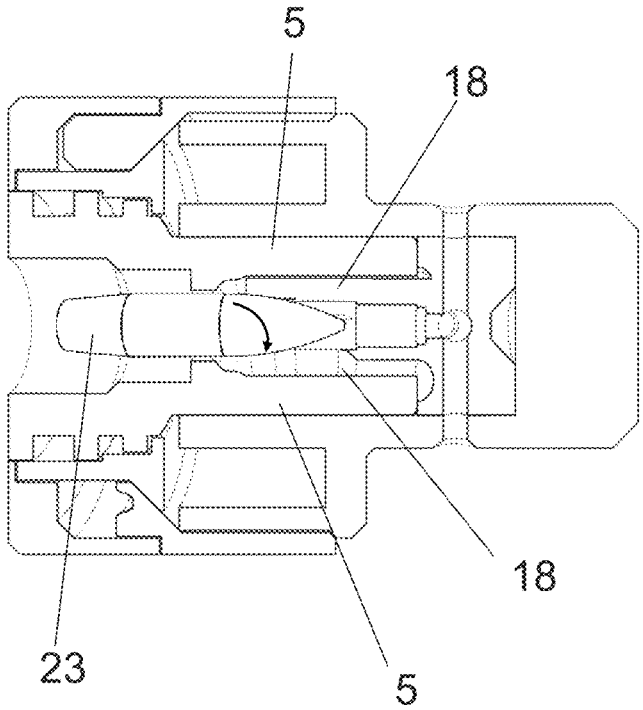

In FIG. 15, the live bullet 23 advances in the bullet deforming part 14 and the stationary cutter blades 18 of the bullet deforming part 14 is hit by the outer surface of the live bullet 23 causing the rotation of the live bullet 23 to further slow down and causing material to be detached from the outer surface of the live bullet 23.

Figure 16:
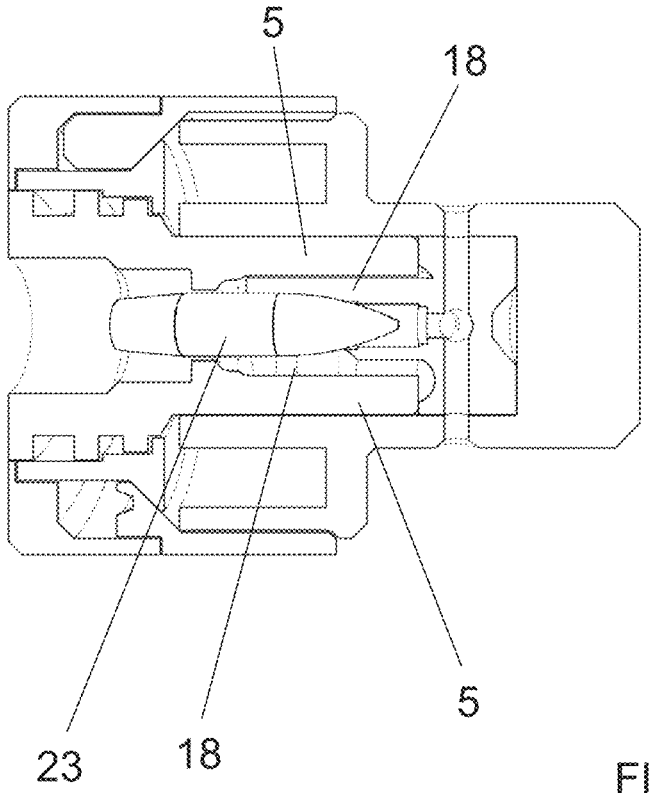

In FIG. 16, the live bullet 23 advances further in the bullet deforming part 14 and the stationary cutter blades 18 of the bullet deforming part 14 is hit by the outer surface of the live bullet 23 causing the rotation of the live bullet 23 to stop and causing material to be detached from the outer surface of the live bullet 23.

It is apparent to a person skilled in the art that as technology advanced, the basic idea of the invention can be implemented in various ways. The invention and its embodiments are therefore not restricted to the above examples, but they may vary within the scope of the claims.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the disclosure states otherwise. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A firearm attachable bullet trap comprising: a hollow body configured to be releasable connected a muzzle end of a rifle barrel of a firearm, wherein the hollow body at least partially defining a ballistic plate chamber, and wherein the hollow body includes a first proximal end and a first distal end, a ballistic plate, a bullet deforming part within the hollow body, wherein the bullet deforming part includes a central channel and the central channel has a central axis A, and a gas track extending between the central channel and the atmosphere, wherein the central channel of the bullet deforming part includes an open-sided channel section radially limited by stationary cutter blades, wherein each of the stationary cutter blades has a second proximal end and a second distal, wherein the central channel of the bullet deforming part includes a first proximal open end at the second proximal ends of the stationary cutter blades and a second distal end, and wherein the stationary cutter blades are equally spaced about the central axis A of the central channel.

2. The firearm attachable bullet trap according to claim 1, further comprising:

an open-end flash suppressor include elongated tines projecting from a base of the open-end flash suppressor, wherein the open-end flash suppressor is attached to the muzzle end of the rifle barrel of the firearm, wherein the hollow body is releasably attached to the open-end flash suppressor.

3. The firearm attachable bullet trap according to claim 1, wherein:

each of the stationary cutter blades includes at least one of a stepped, a curved or an angled configuration so that a cross section of the closed-side channel section of the central channel reduces in steps and/or is stepless towards the second distal end of the central channel.

4. The firearm attachable bullet trap according to claim 1, wherein:

the bullet deforming part is releasably received within the hollow body.

5. The firearm attachable bullet trap according to claim 4, wherein: the bullet deforming part is attached to the hollow body such that the bullet deforming part is allowed to move with respect to the hollow body in response to kinetic energy from a bullet moving in the central channel.

6. The firearm attachable bullet trap according to claim 1, wherein the bullet deforming part is secured against rotation in the hollow body.

7. The firearm attachable bullet trap according to claim 1, wherein:

the central channel includes a closed-sided channel section extending from the open-sided channel section.

8. The firearm attachable bullet trap according to claim 7, wherein:

the closed-sided channel section of the central channel includes a blind hole extending from the open-sided channel section, wherein the second distal end of the central channel is a bottom of said blind hole.

9. The firearm attachable bullet trap according to claim 7, wherein:

the closed-sided channel section of the central channel includes a through hole extending from the open-sided channel section, wherein the second distal end of the central channel is open to the ballistic plate chamber.

10. The firearm attachable bullet trap according to claim 1, wherein:

the bullet deforming part includes a body part;

the closed-side channel section is in the body part, and the stationary cutter blades project from the body part.

11. The firearm attachable bullet trap according to claim 1, wherein:

the bullet deforming part includes a recess at a third distal end of the bullet deforming part, wherein the recess is at an extension of the central axis of the central channel of the bullet deforming part, and the ballistic plate chamber is between the recess and the ballistic plate.

12. The firearm attachable bullet trap according to claim 1, wherein: the bullet deforming part plastically deforms in response to receiving kinetic energy from a bullet moving in the central channel.

13. The firearm attachable bullet trap according to claim 1, wherein:

each of the stationary cutter blades has a similar configuration.

14. The firearm attachable bullet trap according to claim 1, wherein: the open-sided channel section of the central channel of the bullet deforming part has a longitudinal slit between two adjacent ones of the stationary cutter blades.

15. The firearm attachable bullet trap according to claim 14, wherein:

the longitudinal slit between the two adjacent ones of the stationary cutter blades opens to a longitudinal space between the two adjacent ones of the stationary cutter blades.

16. The firearm attachable bullet trap according to claim 2, wherein:

the elongated tines of the open-end flash suppressor are, when the bullet trap is releasably connected to the open-end flash suppressor, configured to project into the longitudinal spaces between adjacent ones of the stationary cutter blades, and the elongated tines of the open-end flash suppressor are configured to abut the stationary cutter blades.

17. The firearm attachable bullet trap according to claim 16, wherein:

each of the stationary cutter blades includes an anticlockwise side in a circumferential direction about the central axis A of the central channel, each of the stationary cutter blades includes a clockwise side in a circumferential direction about the central axis A of the central channel, and the elongated tines of the open-end flash suppressor are configured to abut one of the clockwise sides of the stationary cutter blades and an anticlockwise side of the stationary cutter blades.

* * * * *